US005457484A

United States Patent [19]

Regnault et al.

[11] Patent Number: 5,457,484

[45] Date of Patent: Oct. 10, 1995

[54] INK JET PRINTING HEAD

[75] Inventors: Luc Regnault, Monteleger; Eric Bonnet, Chabeuil, both of France

[73] Assignee: Imaje, Bourg les Valence, France

[21] Appl. No.: 687,925

[22] PCT Filed: Oct. 12, 1990

[86] PCT No.: PCT/FR90/00730

§ 371 Date: Jul. 24, 1991

§ 102(e) Date: Jul. 24, 1991

[87] PCT Pub. No.: WO91/05663

PCT Pub. Date: May 2, 1991

[30] Foreign Application Priority Data

Oct. 16, 1989 [FR] France ..... 89 13719

[51] Int. Cl.[6] ..... B41J 2/18

[52] U.S. Cl. ..... 347/74; 347/90

[58] Field of Search ..... 347/74, 89, 90

[56] References Cited

U.S. PATENT DOCUMENTS

| | | | |
|---|---|---|---|
| 3,956,756 | 5/1976 | Paton | 347/74 X |
| 4,060,804 | 11/1977 | Yamada | 347/77 |
| 4,219,822 | 8/1980 | Paranjpe | 347/42 |
| 4,268,836 | 5/1981 | Huliba et al. | 347/74 |
| 4,307,407 | 12/1981 | Donahue et al. | 347/74 |
| 4,364,055 | 12/1982 | Aiba | 347/74 X |
| 4,791,434 | 12/1988 | Wills | 347/74 X |
| 4,794,407 | 12/1988 | Vonasek | 347/20 X |
| 4,928,114 | 5/1990 | Fagerquist et al. | 347/74 |

FOREIGN PATENT DOCUMENTS 8403474 9/1984 WIPO .

OTHER PUBLICATIONS

IBM Technical Disclosure Bulletin, vol. 16, No. 3, Aug. 1973 Joseph, D. L. "Gutter for Synchronized Ink Jet Printing," pp. 756–757.

*Primary Examiner*—Fred L. Braun
*Attorney, Agent, or Firm*—Pollock, Vande Sande & Priddy

[57] ABSTRACT

An ink jet printing head, particularly intended for printing large characters, includes at least two modulation bodies having respective nozzles fitted with a device for adjusting each of the jets generated by the nozzles. A single module for recovering the ink with only one return line is incorporated in the head. The casing of the head receives, on its face, a support for a cover and, optionally, a second umbilical cover. For printing bar codes, the head provides a cascade sequencing of printed rasters with an increasing order of sequencing of droplets due to a charge voltage. The head is oriented to compensate for the inclination of the raster on the support.

12 Claims, 8 Drawing Sheets

INK JET PRINTING HEAD

FIELD OF THE INVENTION

The invention refers to an ink jet printing head intended particularly for printing large characters. It also refers to any process implementing such a head.

BRIEF DESCRIPTION OF THE PRIOR ART

The applications of ink jet printing are constantly increasing and are leading to a constant search for improved performances. There is a problem with obtaining large characters as they are presently found in applications of the ink jet technique related to the printed characters known as code bars. It was thus desirable to find a solution to this problem. We know that the specifications specific to printing code bars dictate height and thickness, as well as the relative positioning of the characters (bars).

BRIEF DESCRIPTION OF THE INVENTION

The goal of the present invention is to meet these requirements while providing the required precision for these parameters, implementing the ink jet technique while remaining within minimal dimensional limits. For this, the applicant had the idea to have at least two nozzles work together in a single casing in such a way that the rasters, produced from the jet emitted by each of these nozzles, fit together, increasing the dimensions of the rasters accordingly. This does not mean simply coupling two printing heads of the standard type, for such a solution would lead to complexity of control and dimensions such that this solution would be hard to use. What is involved is making a number of nozzles fed by a single ink circuit cooperate, as was stated above, in the same casing. These nozzles supply a number of jets of ink drops intended to join together, with the unused drops being recovered in a recovery module shared by all the nozzles.

More precisely, the invention refers to a printing head with a continuous jet of ink drops loaded and deflected to form a raster printed on a support; characterized in that this head has, in a single casing (1), at least two modulation bodies (A and B) comprising the jet nozzles fed by a single ink circuit and a module (30) for recovery of unused drops shared by all the jets, with a single recovery outlet nipple (350), with each of the jets of drops emitted by each of the nozzles controlled in such a way that each of the adjacent rasters printed on the support fit together to form a continuous raster (T).

BRIEF DESCRIPTION OF THE DRAWINGS

The invention will be more easily understood with the help of the explanations below and the attached illustrations, of which.

DETAILED DESCRIPTION OF THE INVENTION

For greater clarity any given elements are denoted by the same references in all illustrations.

In an application related to printing code bars, the thickness of the code dictates the diameter of the nozzles for an ink/printed support combination. The height of the code to be printed, along with the printing speed, dictates the number of nozzles to be incorporated in the printing head as well as the number of drops printed in a raster by each nozzle. In the example described below, which is not the only possibility, there are two nozzles. The relative positioning of the bars requires cooperation among the different nozzles with regard to mechanical adjustments as well as control electronics.

The printing head, in its two-nozzle version in conformity with the invention, will now be described and illustrated through FIGS. 1 through 5, which should be referred to at the same time to understand the description.

Figure 1:
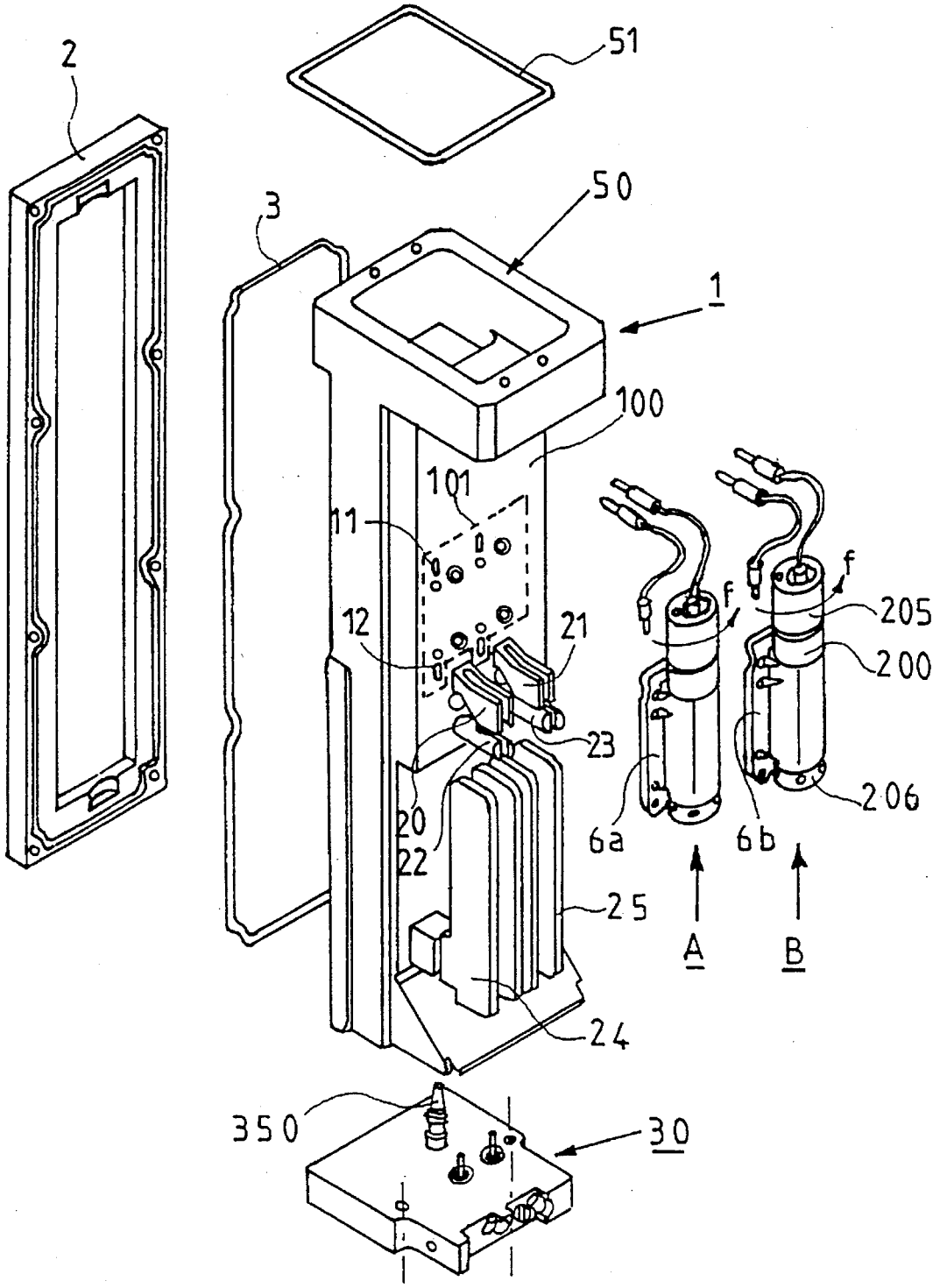
FIG. 1 represents in diagram form and in exploded view a casing of the printing head in conformity with the invention, with all its main components.
Figure 2:
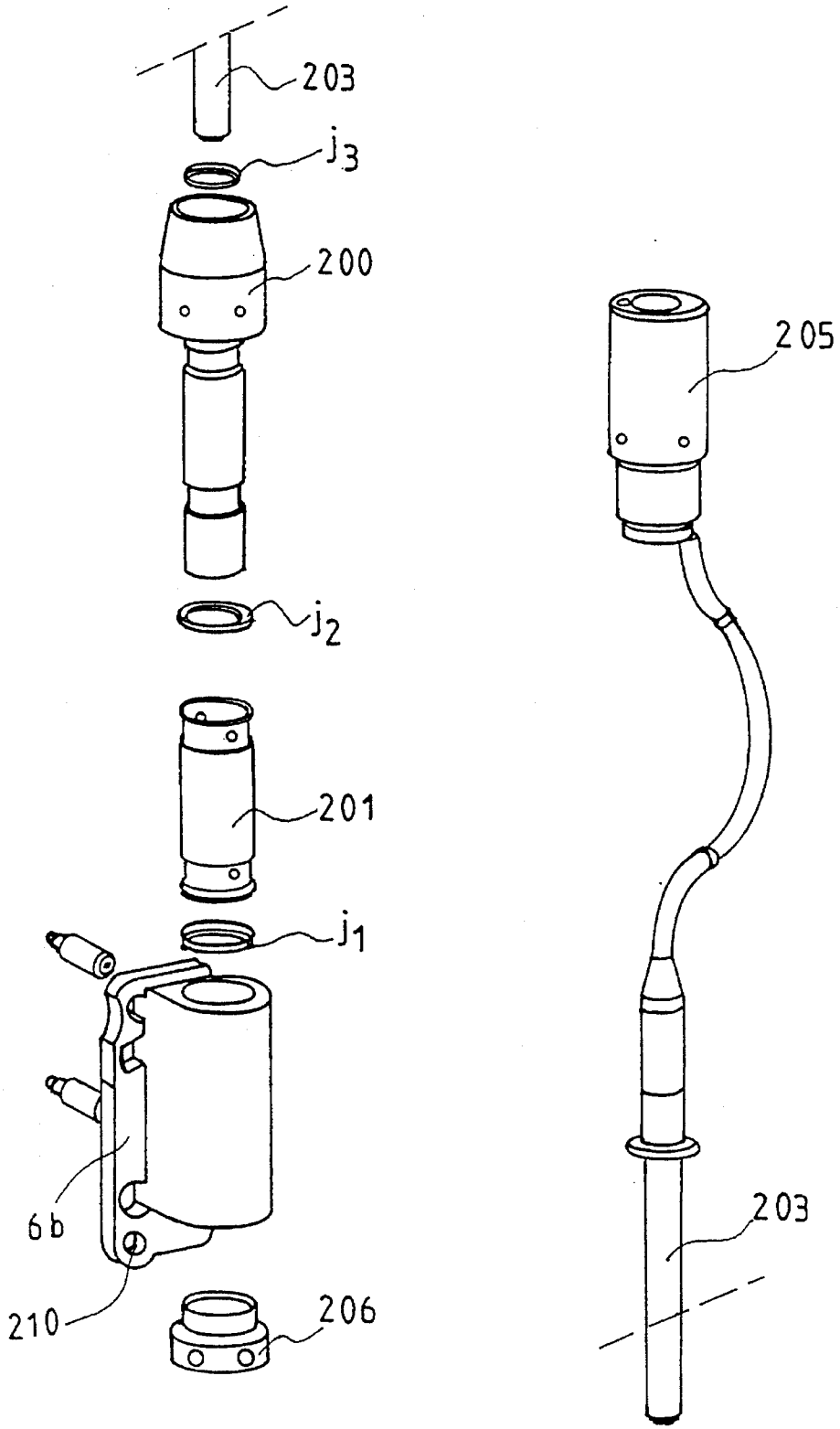
FIG. 2 illustrates in diagram form one of the components shown in FIG. 1.

According to a characteristic of the invention, this printing head is comprised of a single casing (1) with a moveable bottom (2) that is applied against the base (100) of the casing (1), delimiting a compartment that houses the feed pipes and the sole ink recovery pipe, as well as all electric control circuits (not shown). It is made waterproof by a seal (3). On the front of the casing (1), ready to be joined to the base, we showed the two modulation bodies (A) and (B) that can be seen more clearly in FIG. 2. There are two supports (6*a*, 6*b*), each bearing the nozzle-bearing gun (200) which fits together with these supports through a brace (201). Seals ($j_1$, $j_2$) provide waterproofing at this level. The right side of the illustration is normally the extension of the left side. So the resonator in turn fits into the nozzle-bearing gun (200). It is braced by the flange (205), and waterproofing is provided for by seal ($j_3$). A nut (206) makes it possible to tighten the whole and, working with the flange (205), also allows the gun to be adjusted as will be mentioned below. In FIG. 1 only the flange (205), the gun (200) and the nut (206) related to modulation body (B) have been indicated for the sake of clarity in the drawing, but these elements are identical for both modulation bodies (A) and (B).

According to a characteristic of the invention, these modulation bodies (A) and (B) are carried by a gun support (6*a*), (6*b*), and adjustments are provided for on these modulation bodies to ensure proper alignment of the jet for each module (A) and (B) .

This involves:

a) initial means enabling the gun to rotate in the direction of the arrow (f) in order to bring the jet onto a plane parallel to the support surface of supports (6*a*) and (6*b*). This rotation is obtained through a tool inserted in the holes (210) provided for this purpose at the edge of the nozzle-bearing gun. This rotation becomes possible when nut (206) and flange (205) are acted on as was described above;

b) second means to provide pivoting on a first plane, so as to bring the jet of drops that were not loaded, i.e. not used, completely into the recovery drain;

c) third means to correct errors in positioning the parts with respect to each other in order to ensure that the jet is properly in the center of the load electrodes.

These results are obtained for points (b) and (C) through cams moving around in oblong holes (11) and (12). All these means of adjustment make it possible to lead the jets into the drain and to recenter the jet in relation to the load and deflection electrodes.

On the base (100) of the casing (1), in an area (101) delimited by a square drawn in a dotted line, are all the passages provided for ink and electricity to circulate, as well as the passages for the adjustment cams and holding screws for the supports (6*a*) and (6*b*).

On the base (100) of the casing (1) there are also the load electrodes (20) and (21), the load detection electrodes (22), (23) and the deflection electrodes (24), (25). A cover, not shown, set opposite the bottom (2), protects all components.

Unused drops are recovered at a recovery module (30) which, in the invention, is shared by both nozzles and works in such a way that it receives the drops that were not loaded and returns the ink recovered through a single pipe to the general ink circuit.

Figure 3:
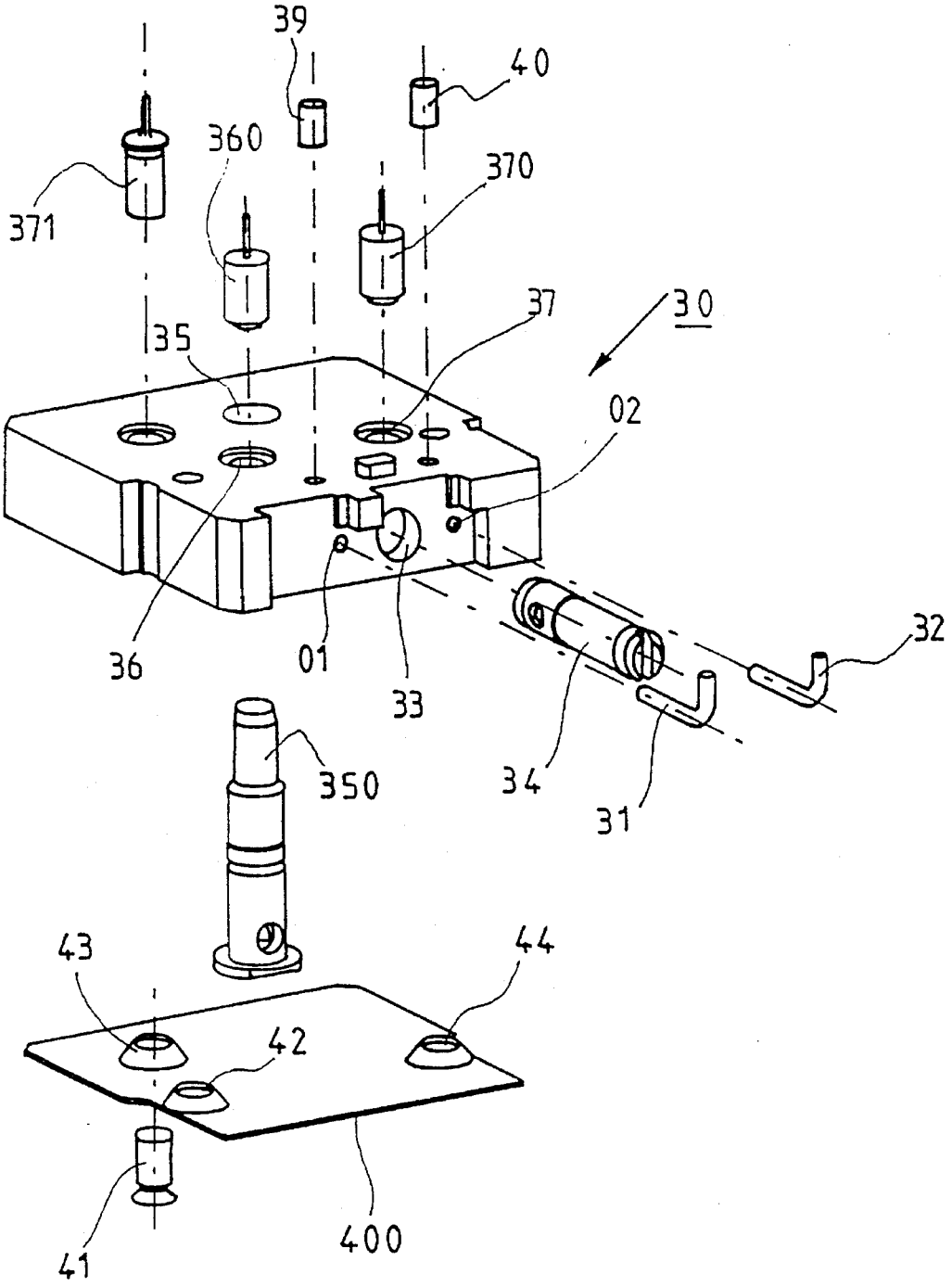
FIG. 3 is a diagram of the recovery module and FIG. 4 is an overhead view of this module to help show how it works.
Figure 4:
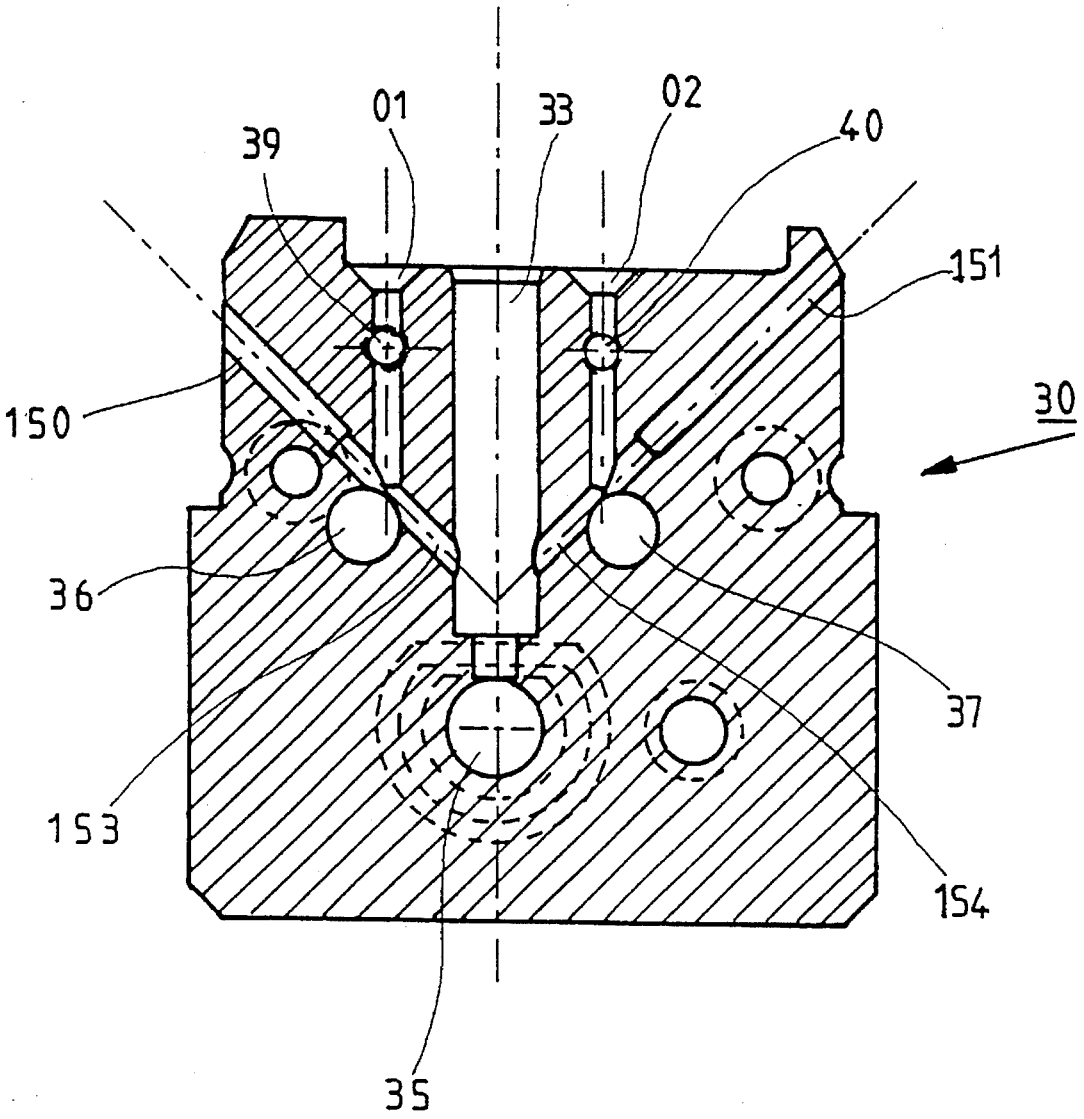

This recovery module (30) is more clearly explained in FIG. 3 and in FIG. 4 which is an overhead view. Each of the jets is recovered in two receiving pipes (31) and (32) which bring the ink into the module (30) by the openings ($O_1$) and ($O_2$). These receiving pipes are connected to recovery pipes (33), equipped with a throttle (34) that allows or stops circulation of the ink to the ink return pipes, responsible for returning the ink to the ink circuit via the exit nipple (350). There are holes (36), (37) tangent to the circulation of the ink, on the trip from the pipes to the pipe system (33), to be used as housing for the electrodes (360) and (370). They work with the nipple (350) placed in the pipe system (35) returning the ink to the feed circuit, to measure the electric impedance of the mixture of ink and air between the joint (350) and the electrodes (360), (370), and to detect any anomaly that may occur. If resistance is too great it means the ink is not circulating and the nozzle in question is stopped up or the jet was poorly recovered. A metal connector (371) and a metal electrostatic discharge plate (400) for the module (30) are provided. Blocking means (39), (40) are also provided to keep the pipes (31, 32) in place, as are screws (41) for attaching this plate onto the module (30), while the connector (371) is joined by the screw (41). As the different parts of the head are made of plastic, there may be electrostatic charges. The plate (400) is placed facing the parts to be printed on, to make an electrostatic screen which prevents electrostatic charges from accumulating at the passing of the drops, something that could affect their trajectory. In FIG. 4 there are holes (150), (151) made necessary in the completion of the pipes (153), (154), holes that have been stopped up permanently.

Figure 5:
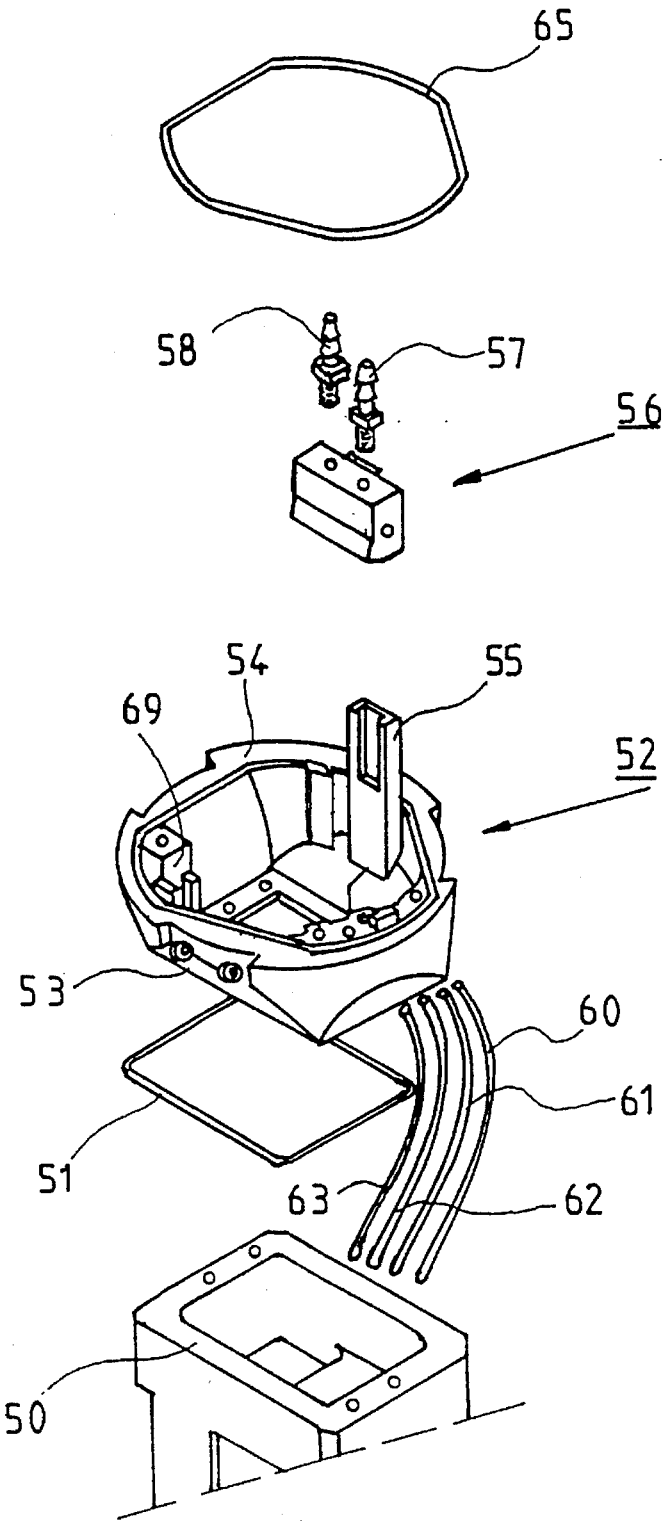
FIG. 5 shows a support intended to be placed on the casing in FIG. 1.

In another major characteristic of the invention, the casing (1) (FIG. 1 has a support surface (50) that has a seal (51) intended to receive a support (52) illustrated in FIG. 5.

This support has one face (53) the profile of which fits that of the support surface (50) of the casing (1). The two parts are joined by any known means, and the seal (51) makes it waterproof. The support (52) has a second support surface (54) parallel to the first and with a more or less circular profile. This profile will receive the cover (70) known as "ADP cover" since it is protecting the phase detection amplification circuit. The cover can be seen in FIG. 6. The support (52) has an element (55) intended, according to the invention, to bear an ink distributor (56) connected to the general ink circuit by two entry (57) and exit (58) nipples located upstream. At the exit of the distributor (56) there are (downstream) two feed pipes (60, 61) and two drain pipes (62, 63). From the general ink circuit which, according to a characteristic of the invention, is the same for all nozzles, this distributor (56) is fed ink by nipple (58) and returns the drain ink to this circuit by nipple (57). A single pipe connected to nipple (350) recycles the ink recovered at recovery module (30) level. This pipe, not shown, can be incorporated into the umbilical (72) when the "umbilical" version is involved.

This support (52) also has profiles like (69) to which the electronic control card (ADP) is attached.

Figure 6:
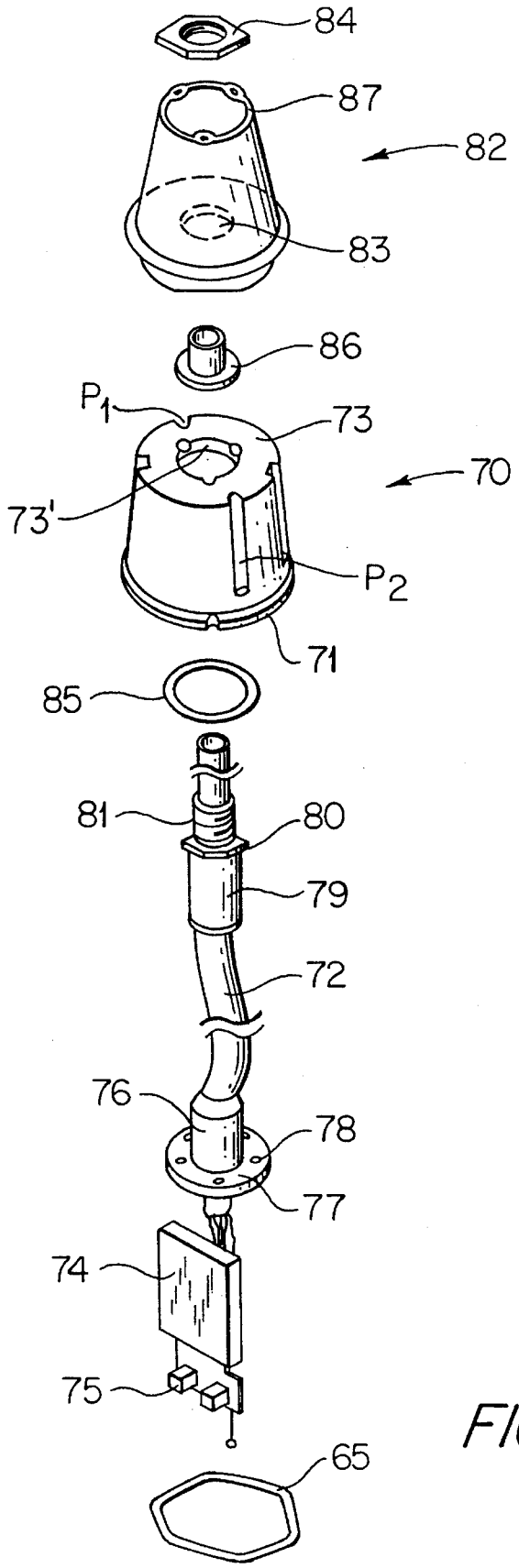
FIG. 6 shows an initial cover to be joined to the support in FIG. 5, and an umbilical and another support implemented when the head according to the invention is working with an umbilical.

A seal (65) ensures waterproofing between the second support surface (54) of the support (52) and the ADP cover (70) shown in FIG. 6.

According to another feature of the invention, a printing head in conformity with the invention is equipped with an ADP (70) cover. Its base (71) fits into the profile of the surface (54) of the support (52) and is joined to it by means of attachment ($P_1$) and ($P_2$). There are two options: the first is applications of the printing head without umbilical and the second is applications with umbilical.

In FIG. 6 we see the version with umbilical (72), but if the latter is disregarded we get the first version. In this case the ADP cover (70) is joined to the support (52) by any known means, without forgetting the seal (65). Its second surface (73) is directly joined to the ink circuit (not shown). Its rotating profile makes it possible, by means of an adaptor that is already familiar, to orient the head with respect to the main body of the printer. The electrical connections, on the one hand, and the ink pipes, on the other hand, are directly connected to the electronic control card (ADP) (74) and to the ink distributor (56), respectively. The electronic control card (74) is kept in place inside the cover (70) with the help of the parts (75) that rest against the profiles (69) of the support (52).

In the version implementing an umbilical (72), it has at one of its ends a nipple (76) with a flange (77) that has a number of fixing holes (78). This flange (77) comes to rest against the inside of the cover (70) and is attached by these fixing holes to the inside surface (73) of the cover (70). The other end of the umbilical (72) has a second nipple (79) with a nut (80) and a threaded stem (81). A second cover (82) called the "umbilical cover" receives this nipple (79) whose threaded stem (81) goes through the hole (83), with the assembly being locked by a nut (84). Seals (85), (86) provide waterproofing. The upper face (87) of the umbilical cover (82) is joined to the ink circuit (not shown).

The printing head has a number of nozzles, each of which has jet adjusting means that are independent for each nozzle, and a single ink recovery module with a single return pipe to the general circuit.

As was said above, the printing head, in conformity with the invention, allows at least two modulation bodies (A) and (B) to cooperate in such a way that the rasters, created by the jet emitted by each of the nozzles, fit together, thus increasing the raster dimensions accordingly.

Positioning the bars requires cooperation between the different nozzles, with respect to mechanical adjustments as well as to control electronics. This cooperation will now be described. It is a process of implementing means described previously with adapted electronic control means, leading to an example of application.

In implementing this application, the code bars are printed by juxtaposing and joining the rasters emitted by the adjacent nozzles.

In a basic feature of the invention, there is an increasing order of sequencing of drops and of the charge voltage in the raster, so that regardless of the speed of the printing head's relative passing over the support, the raster maintains its rectilinear appearance.

Figure 7:
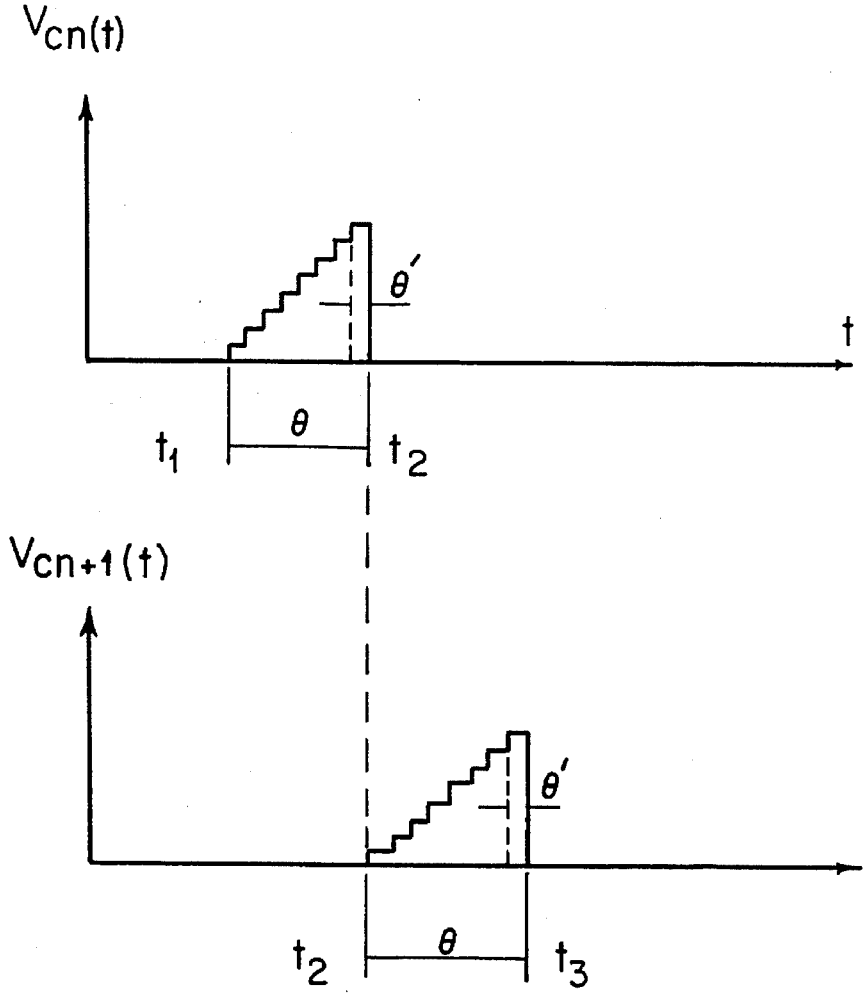
FIG. 7 is a diagram explaining the sequencing that loads the drops.

In a second feature of the invention, there is cascade sequencing of the rasters printed by the two adjacent nozzles so that the rasters printed are continuations of each other, thus completing a very high bar, regardless of the travelling speed of the support. This characteristic is illustrated using the diagram in FIG. 7. These are the two diagrams of the function (Vc), charge voltage of the drops as a function of time for each of the two adjacent nozzles referred to (n) and (n+1). In this diagram we see that charge voltage increases with plateaus for a period ($\Theta'$) during the period $(t_2-t_1)=(\Theta)$ for one of the jets, and $(t_2-t_3)=(\Theta)$ for the other jet. These two periods ($\Theta$) are equal.

Figure 8:
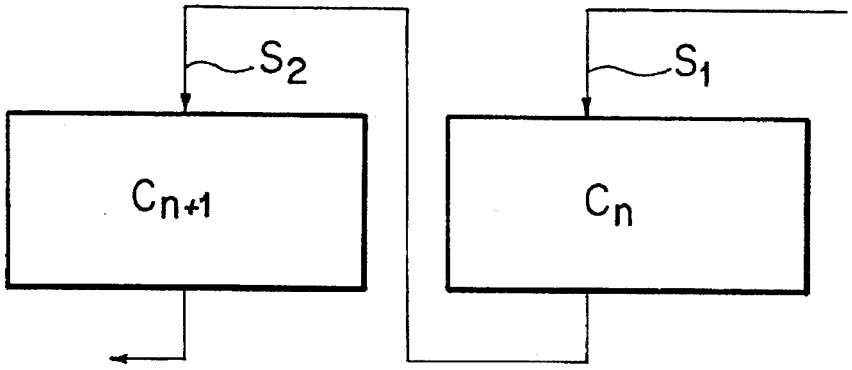
FIG. 8 is a diagram of the arrangement of the logical sequencing circuits.

This result is obtained following a sequencing logic shown in FIG. 8. The signal ($S_1$) at starting time ($t_1$) for the printing sequence is sent into the printing sequencing ($C_n$) logical circuit, corresponding to the jet emitted by the nozzle ($_n$). When a raster has finished being printed by ($_n$), the signal ($S_2$) at time ($t_2$) triggers the printing sequencing ($C_n$+1) logical circuit controlling the jet of the nozzle (n+1) until the end of printing of the corresponding raster ($t_3$).

In a third feature of the invention, the printing head must be directed around an axis (OZ) perpendicular to the plane of the support to be printed on (x, o, y) so as to make up for the possible incline ($\alpha$) of the raster on the axis (y), which is the result of combining a relative passing speed (V) for the support with sending a series of successive drops to print the raster during the period ($\Theta$). These parameters are bound by the relation:

$$2V\Theta=H \text{ tg } (\alpha)$$

where H is the height of the resulting printed raster (T).

Figure 9:
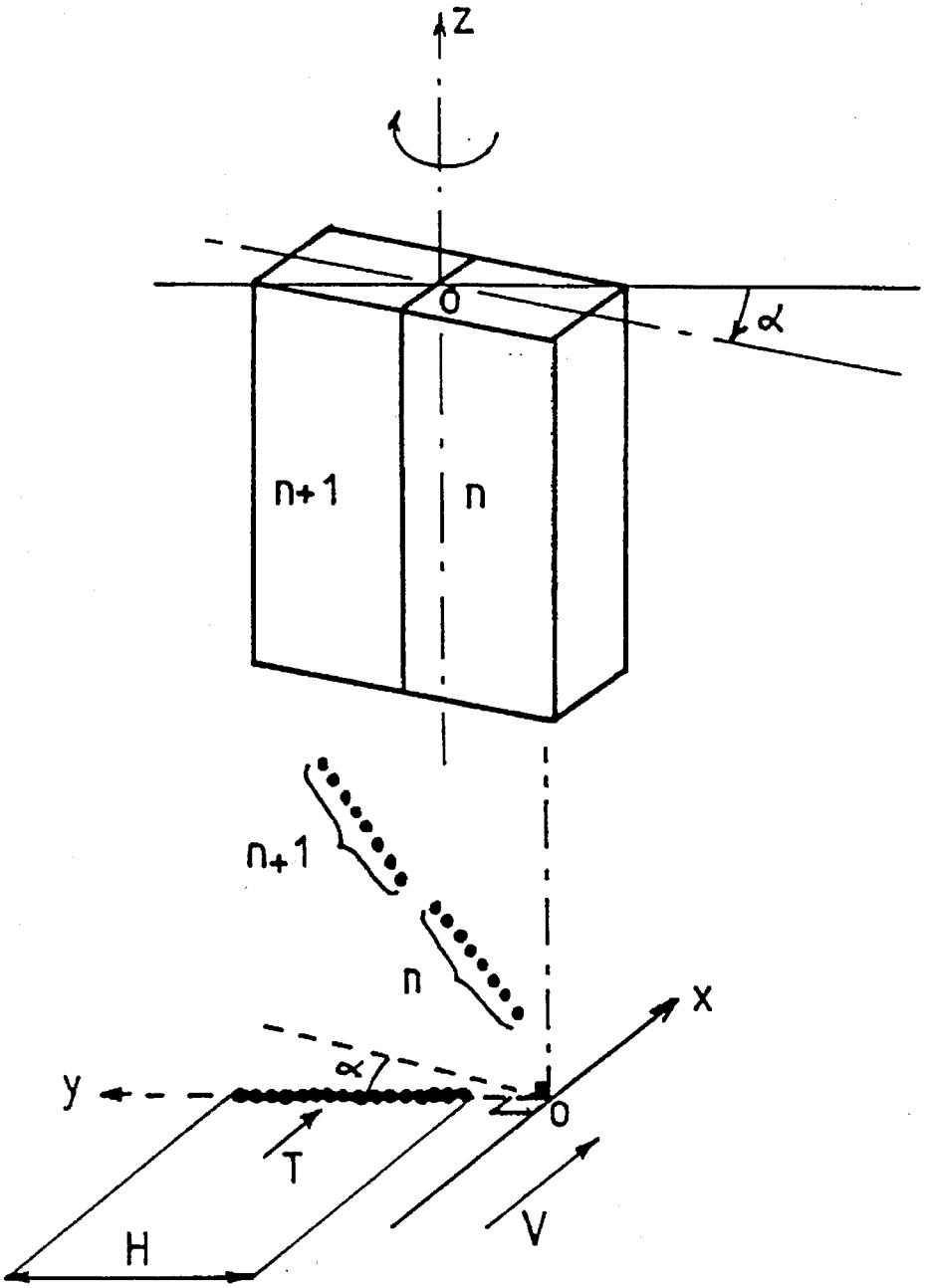
FIG. 9 is an additional explanatory diagram.

In FIG. 9 we see the combination of the drops flying in the plane of deflection of the two nozzles (n) and (n+1), the plane of the support (x, o, y), and the high (H) raster produced (T) on the support travelling at speed (V).

The invention can be applied in ink jet marking techniques, particularly in printing large characters (logo, graphics) and code bars.

We claim:

1. An ink jet printing head for emitting continuous jets of charge and deflected ink drops so as to form a pattern printed on a support, the head comprising, in a single housing:

at least two modulation barrels having ejection nozzles fed by a common ink circuit;

a recovery module for recovering unused ink drops that are common to all jets, the module having a single recovery outlet;

control means for controlling the jets of ink drops emitted by each nozzle in such a way that said pattern, printed on the support by the adjacent nozzles, is continuous;

wherein said housing includes a base which is closed on one side by a removable bottom defining a compartment, housing ink intake pipes of said common ink circuit;

a single recovery pipe connected to said recovery module and electric control circuits of said control means;

wherein said compartment includes, on an opposite side of the base, integral means of support for said modulation barrels;

said integral means of support each having an ejection nozzle fixed by a flange in a nozzle carrier jet pipe nested inside said means of support, said flange permitting the rotation of said jet pipe;

said base having oblong holes cooperating with adjustment means integral with said means of support for ensuring pivoting of the ink jet toward said recovery module;

other oblong holes cooperating with other adjustment means integral with said means of support for ensuring correct centering of the ink jet in a respective charge electrode positioned on said means of support adjacent said ejection nozzle;

said charge electrodes being used to apply electric charge to said ink jets.

2. An ink jet printing head according to claim 1, wherein said recovery module further comprises, for each jet:

a receiver tube delivering ink in a main recovery duct;

said receiver tube being equipped with a throttle chamber which allows or prohibits circulation of the ink toward said single recovery outlet connected to said common ink circuit.

3. An ink jet printing head according to claim 2, further comprising two holes provided tangentially to the circulation of the ink for housing two electrodes, respectively, said holes cooperating with said recovery outlet for measuring the electric impedance of an air/ink mixture between said outlet and said two electrodes.

4. An ink jet printing head according to claim 3, further comprising a metallic plate integral with said recovery module that prevents any electrostatic charges from accumulating in the path of the drops.

5. An ink jet printing head according to claim 1, wherein said housing further comprises a support surface for receiving a support including a first surface having a profile corresponding to that of the support surface; and a second surface having a profile that is substantially circular for receiving a cover that encloses the control circuits.

6. An ink jet printing head according to claim 5, wherein said support further comprises:

an element supporting an ink distributor equipped with one upstream inlet as well as one upstream outlet;

two downstream pipes for feeding each of said modulation barrels with ink; and two downstream drainpipes.

7. An ink jet printing head according to claim 6, wherein said support further comprises profiles to which a card mounting said electronic control circuits is securely kept in place, inside the cover.

8. An ink jet printing head according to claim 7, wherein said cover is fixed on a main body of a printer so that the entire printing head is adjustable.

9. An ink jet printing head according to claim 7, wherein said cover receives an umbilical means further comprising a first terminal equipped with a collar supported inside the cover; and a second terminal receiving a second cover that is integral with said printer head.

10. An ink jet printing head according to claim 1, wherein the control means generates electrical signals for sequencing, in ascending order, the charge voltage of the ink drops in the pattern, in order to obtain bar codes.

11. The ink jet printing head according to claim 10, wherein the charge voltage sequencing causes printed patterns that are extensions of each other.

12. The ink jet printing head according to claim 11, further comprising means for adjusting the ink jet printing head around an axis perpendicular to a plane of the printing support thus compensating for a slant of the pattern on the axis.

* * * * *